US005197618A

United States Patent [19]

Goth

[11] Patent Number: 5,197,618

[45] Date of Patent: Mar. 30, 1993

[54] TAMPER-EVIDENT FUSION BONDED PULL-TAB INDUCTION FOIL LINING SYSTEM FOR CONTAINER CLOSURES

[75] Inventor: Thomas P. Goth, Scottsdale, Ariz.

[73] Assignee: Top Seal, Inc., Tempe, Ariz.

[21] Appl. No.: 776,185

[22] Filed: Oct. 15, 1991

[51] Int. Cl.[5] ..... B65D 43/02; B65D 53/04

[52] U.S. Cl. ..... 215/232; 215/258; 215/347; 215/349; 220/359; 229/123.1; 229/123.2; 206/484.2

[58] Field of Search ..... 215/232, 251, 258, 341, 215/347, 349; 220/359, 258, 276; 229/123.1, 123.2, 125.35; 206/438, 363, 484.2, 524.2, 532

[56] References Cited

U.S. PATENT DOCUMENTS

| | | | |
|---|---|---|---|
| Re. 29,705 | 7/1978 | Compere | 206/484.2 X |
| 2,646,183 | 7/1953 | Pellett | 215/347 |
| 2,715,474 | 8/1955 | Phillips | 215/347 |
| 3,083,821 | 4/1963 | Woodson | 229/125.35 X |
| 3,355,059 | 11/1967 | Balocca et al. | 229/123.2 X |
| 3,501,042 | 3/1970 | Risch et al. . | |
| 4,013,188 | 3/1977 | Ray | 215/347 |
| 4,055,672 | 10/1977 | Hirsch et al. | 229/123.1 X |
| 4,280,653 | 7/1981 | Elias . | |
| 4,379,008 | 4/1983 | Gross et al. | 229/123.2 X |
| 4,418,834 | 12/1983 | Helms et al. | 220/359 |
| 4,438,850 | 3/1984 | Kahn | 229/123.1 X |
| 4,451,526 | 5/1984 | Claude et al. . | |
| 4,501,371 | 2/1985 | Smalley . | |
| 4,588,099 | 5/1986 | Diez . | |
| 4,596,338 | 6/1986 | Yousif | 215/232 |
| 4,666,052 | 5/1987 | Ou-Yang | 215/230 |
| 4,693,390 | 9/1987 | Hekal | 220/359 |
| 4,721,217 | 1/1988 | Phillips et al. . | |
| 4,757,914 | 7/1988 | Roth et al. | 220/359 |
| 4,771,937 | 9/1988 | Kamada et al. | 229/123.1 |
| 4,784,885 | 11/1988 | Carespodi | 229/123.2 X |
| 4,857,369 | 8/1989 | Dehlenschlaeger . | |
| 4,930,646 | 6/1990 | Emslander | 215/232 |
| 4,934,544 | 6/1990 | Han et al. . | |
| 4,960,216 | 10/1990 | Giles et al. | 215/232 |
| 4,988,004 | 1/1991 | Intini | 206/532 |
| 5,004,111 | 4/1991 | McCarthy | 215/232 |
| 5,012,946 | 5/1991 | McCarthy | 220/258 |

*Primary Examiner*—Allan N. Shoap
*Assistant Examiner*—Vanessa Caretto
*Attorney, Agent, or Firm*—LaValle D. Ptak

[57] ABSTRACT

A tamper-evident multiple layer induction foil liner for sealing the opening of a container comprises a "sandwich" having a first layer in the form of a fusion-bond heat seal polymer. This heat seal polymer is fusion bonded to the lip of the container opening to secure the liner to the opening. The next layer is a low-cohesive strength layer which, in turn, is bonded to an aluminum foil layer strengthed with tear-resistant backing. A pull-tab is provided to facilitate removal of the liner after the cap is removed from the container. When the pull-tab is lifted, the low-cohesive strength layer splits or shears through the application of a relatively small amount of force. Thus, the aluminum foil and tear-resistant backing readily may be removed from the container opening. It is then a simple matter to puncture the thin and mechanically weak polymer layer to uncover the container opening. A residue of the fusion bonded polymer, with a surface covering of a portion of the sheared low-cohesive strength layer, provides a readily observable tamper-evident residue on the lip of the container opening after the liner has been removed.

11 Claims, 1 Drawing Sheet

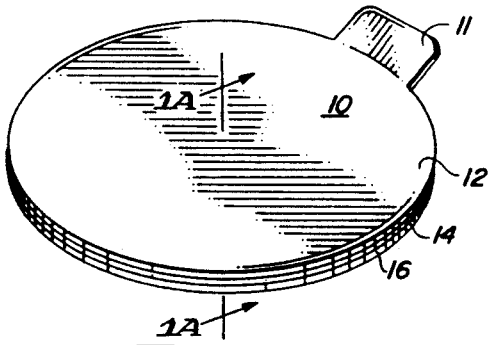
FIG. 1
(PRIOR ART)
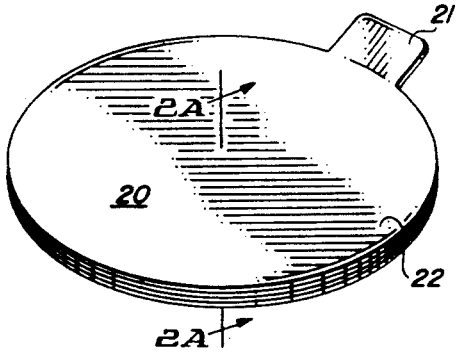
FIG. 2
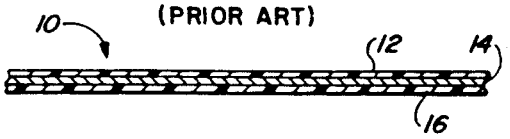
FIG. 1A
(PRIOR ART)
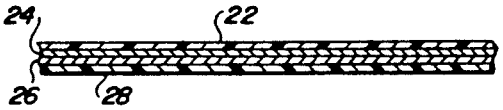
FIG. 2A
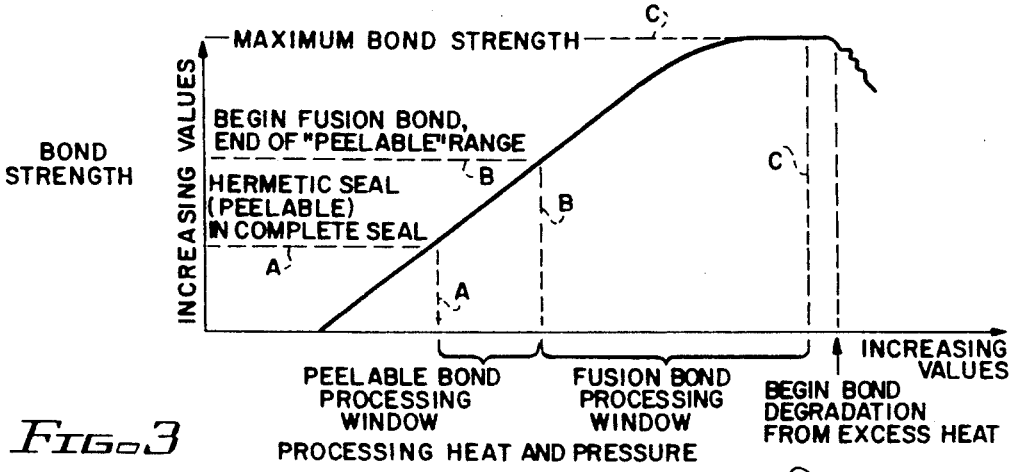
FIG. 3
FIG. 4
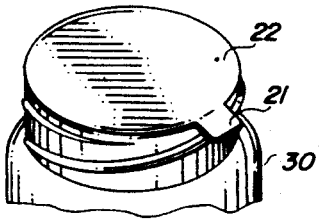
FIG. 8
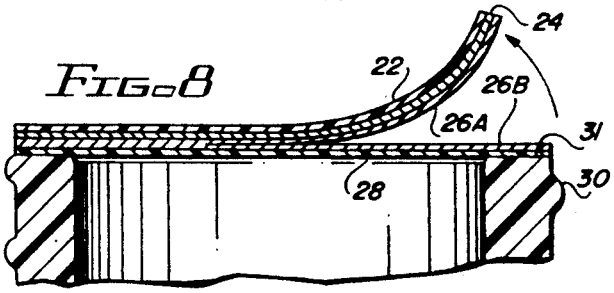
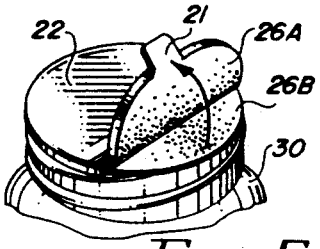
FIG. 5
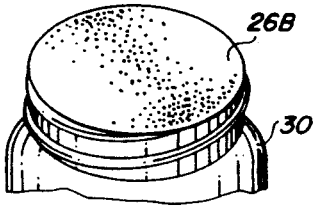
FIG. 6
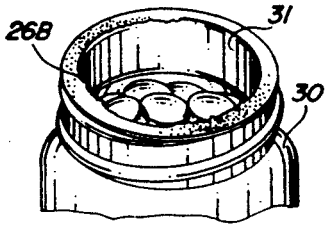
FIG. 7

TAMPER-EVIDENT FUSION BONDED PULL-TAB INDUCTION FOIL LINING SYSTEM FOR CONTAINER CLOSURES

BACKGROUND

Tamper-evident induction foil lining systems have been used in the container closure industry for more than twenty years. Usage of such lining systems has increased significantly within the past decade, because of tampering with the contents of over-the-counter drugs and other products.

When conventional induction foil disks are used to seal the closure opening, removal of the disks is frequently frustrating and difficult. When the disk is fused to the container opening, removal or opening of the foil inner seal usually requires the use of a sharp object or fingernail to break, with considerable force, the foil; so that it can be torn away from the opening. The benefits of providing a tamper-evident seal across the container opening are offset by the considerable difficulty in removing the seal from the opening, and the resulting consumer dissatisfaction.

Recently, some induction foil disk systems have been provided with an integral pull-tab to facilitate removal of the foil disk from the container opening. The tab is intended to be gripped by the consumer, and pulled upward and across the container opening to peel a foil polymer disk off the container lip. This approach has utilized a "peelable bond" induction foil material to seal the container opening. When a pull-tab is used with such a "peelable bond" material, the liner theoretically is removed with a clean peel off the container opening. The amount of force to achieve this, theoretically at least, is less than that required to break the aluminum foil layer when the liner is fused to the lip of the container.

Several problems exist in conjunction with peelable bond systems, however. First of all, for materials presently used in such systems, it is difficult for the packager to achieve a hermetic seal at all points on the container lip (particularly beneath the folded tab, which can shield the area beneath it from the induction sealing energy field), while also maintaining a "peelable" bond strength at which the tab can function. The processing window for producing peelable bond sealing of the foil liner to the container opening is relatively narrow (that is, a narrow range of processing heat and pressure will provide the desired "peelable" bond strength). In contrast, the processing window to create a "fusion bond" seal is relatively wide. The result is that many packagers who want to use a pull-tab system cannot, due to the narrow processing window for peelable bond systems, and limited process control capabilities. These limited capabilities result from poor application torque control, unskilled work force, equipment limitations, short-run productions, and others.

Even if all of the processing limitations can be met to provide a good "peelable bond" induction foil seal, a lower degree of tamper evidency results. This is because the inherent nature of a "peelable" bond is to leave a clean bottle lip surface when the liner is removed from the container opening. This lessened tamper evidency is considered objectionable by much of the vitamin, over-the-counter drug and pharmaceutical industry, and has limited interest of many packagers who require readily visible tamper evidency when the liner is removed. Fusion bonded materials provide such a high level of tamper evidency because a polymer or foil residue remains on the container lip after the liner rupture or removal has taken place.

Another problem with peelable bond pull-tab systems is that the proper operation of a peelable bond integral pull-tab liner is totally dependent upon the relative strength of the liner/bottle-opening bond strength versus the tensile strength or tear resistance of the tab itself. Unfortunately, the bond strength of the liner to the container opening varies considerably with processing conditions. Consequently, it has been a common occurrence for induction sealing process variations to produce bonds which are too strong for the tab to handle. If the bond strength is too high, the tab snaps or tears without removing the liner disk from the container opening. This leaves the consumer frustrated with the performance of the tab system.

Consequently, it is desirable to provide a pull-tab tamper-evident induction foil lining system which overcomes the disadvantages noted above for the prior art systems.

SUMMARY OF THE INVENTION

It is an object of this invention to provide a class of improved induction foil lining materials for use in the sealing of container openings.

It is another object of this invention to provide an improved pull-tab induction foil lining system for container closures.

It is an additional object of this invention to provide an improved fusion-bonded induction foil liner system for sealing the openings of containers.

It is a further object of this invention to provide an improved pull-tab fusion-bonded induction foil lining system for sealing container openings which can be applied to container openings with a high degree of reliability, and removed from the container opening easily, consistently, and with uniform force, and provide clear residual evidence on the container that the liner disc has been removed.

In accordance with a preferred embodiment of this invention, a liner for use in induction sealed systems includes at least three layers. The first of these layers is a fusion-bond heat seal polymer layer, which is intended to be fusion bonded to a container opening. A relatively strong backing layer is provided; and a low-cohesive strength layer is placed between, and bonded to, the polymer layer and the backing layer. The low-cohesive strength layer shears upon removal of the backing layer by mechanical forces, to leave the polymer layer bonded to the container opening. The polymer layer is relatively weak, and may readily be punctured with little force to complete the opening of the container.

BRIEF DESCRIPTION OF THE DRAWING

FIG. 1 is a perspective view of a prior art induction foil liner;

FIG. 1A is a cross section of the liner of FIG. 1;

FIG. 2 is a perspective view of a preferred embodiment of the invention;

FIG. 2A is a cross sectional view of the embodiment of FIG. 2;

FIG. 3 is graph useful in describing the process of bonding the liners of FIGS. 1 and 2 to a container;

FIGS. 4 through 7 illustrate sequential steps involved in the removal of a liner made in accordance with a preferred embodiment of the invention from a container opening; and FIG. 8 is a cross-sectional view of the liner of FIG. 2 showing the manner in which it is removed from a container.

DETAILED DESCRIPTION

For the purposes of this document, the term "fusion bond" or "fusion-bonded" will be construed to include all types of aggressive polymer bonding which is of sufficient strength to resist peeling of the heat seal polymer from the sealed substrate.

Reference now should be made to the drawing in which the same reference numbers are used throughout the different figures to designate the same or similar components. FIG. 1 is a perspective view of a typical foil liner 10 with a pull-tab 11 of the type which is used to seal the openings in containers of various products. The liner 10 with the integral pull-tab 11 (folded to overlie the surface of the liner 10) generally are cut by machine from strips of liner materials, and are inserted into threaded caps prior to the attachment of the caps to the container which is to be sealed by the liner.

In the packaging process, the cap, carrying the liner 10, is threaded onto the top of the container. The liner then is bonded by induction heating to the lip of the container to secure it to the container. This is accomplished by making the liner as a sandwich of at least two different layers. As shown in FIG. 1, a typical three-layer liner is illustrated.

As illustrated in FIGS. 1 and 1A, the liner is an induction foil liner, which has an inner layer 14 made of aluminum foil or other suitable metal foil. An outer tear-resistant backing 12, made of any suitable material, is bonded to the aluminum foil layer 14 on the upper surface. The lower surface of the aluminum foil layer is bonded to a "peelable bond" heat seal polymer 16. When the cap is tightened onto the top of the container, it then is processed through an induction heating apparatus to cause the layer 16 to form a hermetic "peelable" seal with the lip of the container on which the liner and cap are placed.

As illustrated in FIG. 3, the heat and pressure range for providing a "peelable bond" between the polymer layer 16 and the lip of a plastic or glass container (such as a jar 30, shown in FIG. 4) is relatively narrow, and extends between points "A" and "B" on the graph of processing heat and pressure versus bond strength shown in FIG. 3. If the processing heat and pressure exceed the value "B" shown in FIG. 3, the "peelable range" is exceeded and fusion bonding of the layer 16 to the lip of the container takes place. For the typical prior art container, this is not desirable for the reasons given above in the background portion of this specification.

FIGS. 2 and 2A show an improvement over the prior art system of FIGS. 1 and 1A. The system of FIGS. 2 and 2A permits a fusion bonding of the induction foil liner to the lip of the opening of the container 30. This greatly widens the heat sealing processing window for the packager. This system also provides a consistent and easy removal of the liner from the container opening while, at the same time, providing a tamper-evident residue on the container. The consistent performance of the new pull-tab system is inherent in the design of the lining material itself. The tear resistance and tensile strength of the pull tab is always greater then the cohesive strength of the low-cohesive strength layer 26. In contrast, the prior art device of FIGS. 1 and 1A does not provide residual evidence of the removal of the liner on the container once the liner has been successfully removed.

The liner 20 of FIG. 2 has a pull-tab 21 which is comparable to the pull-tab 11 of the liner 10 of FIG. 1. The liner is inserted into a cap in the same manner as the prior art liner; so that production machinery does not have to be changed to utilize the improved liner of the invention illustrated in FIGS. 2 and 2A.

The liner of FIGS. 2 and 2A, however, has at least one extra layer added to it over the prior art liner of FIG. 1. Otherwise, the layers are comparable to one another. For example, the primary layer is an aluminum foil layer 24, which has a tear-resistant backing 22 bonded to its upper surface in the same manner as the backing 12 is bonded to the upper surface of the liner 14, shown in FIG. 1A. Instead of bonding the lower surface of the aluminum foil layer, however, directly to a polymer layer, an intermediate low-cohesive strength layer 26 is used to attach a fusion-bond heat seal polymer layer 28 to the lower surface of the aluminum foil layer 24. This low-cohesive strength layer 26 may be made of paper, glassine, or non-woven synthetic fabrics having relatively low shear strength.

In processing the liner of FIGS. 2 and 2A to secure it to the container opening, higher temperatures and pressures are utilized. These are shown in FIG. 3 as extending between lines "B" and "C" to fusion-bond the layer 28 to the lip or edge of the opening in the container 30 to which the liner is to be secured. Since higher temperatures are used, the problems with imperfect hermetic seals, particularly as caused by the folded-over tab 21, are avoided. Sufficient heat and pressure are present to securely fusion bond the heat seal polymer layer 28 to the edge of lip of the container opening. Since a wider processing range is employed, the packager is provided with a wider processing "window"; so that the process control capabilities of the packager can be relaxed considerably over the "peelable bond" system of the prior art.

Reference now should be made to FIGS. 4 through 8 which illustrate the manner of removal of a liner of the type shown in FIGS. 2 and 2A from the lip or opening of a typical container 30. FIG. 4 shows the liner in place, with the bottle cap removed. As with either the prior art liner of FIG. 1 or the liner of FIG. 2, the next step is for the consumer to pull up on the tab 21 and across the top of the container 30 in the direction shown in FIG. 5. Unlike the prior art device of FIG. 1, however, when the tab 21 is pulled by the consumer, the low-cohesive strength layer 26 shears to split into two portions 26A and 26B (shown most clearly in FIGS. 5 amd 8). This allows easy removal of the foil layer 24 and the tear-resistant backing 22 from the container. The amount of force required to accomplish this is relatively low.

After the complete removal of the layers 22 and 24, along with the portion 26A of the low-cohesive strength layer 26, the very thin and relatively weak polymer membrane 28, with a portion of the low-cohesive strength layer 26B, remains across the surface or opening of the container 30 (FIG. 6). It then is a simple matter to rupture the layers 26B and 28 with very little pressure. A light tap of the finger generally is sufficient. The residue then can be torn away, leaving the fusion bonded polymer 28, with the portion 26B of the low-cohesive strength layer 26 adhered to it, clearly showing on the lip 31 of the container 30, as illustrated in FIG. 7. As a consequence, the tamper evidency of the liner of FIGS. 2 and 2A is clearly improved over the clean peelable prior art liner shown in FIGS. 1 and 1A.

It is important, also, to note that once the heat seal polymer layer 28 is fusion bonded to the container lip 31, the function of the integral pull-tab 21 is independent of the bond strength between the polymer and the container. The required removal force depends only on the shearing strength of the low-cohesive strength layer 26, which consistently can be designed into the material used in the layer 26. As a result, consistent operation of the integral pull-tab performance is enhanced. The amount of force needed to remove the foil disk 24 and the tear-resistant backing 22 is consistent, and is not affected by the processing conditions which were used during the bonding of the liner 20 to the opening of the container 30. The benefit of all of this to the consumer is that the consumer can consistently and successfully remove the foil inner seal with predictability, and without requiring the use of a sharp object or risking the breaking of a fingernail.

Since the polymer layer 28 does not need to have any significant puncture resistant capabilities, it can be made quite thin and weak. The strength of the liner disc still is provided by the aluminum foil layer 24 and the tear-resistant backing 22. The amount of force required to puncture this liner disc is substantially the same as required for the prior art liner discs shown in FIG. 1. The difference between the prior art device and the device of the invention illustrated in FIGS. 2 and 4 through 8, however, is that consistent and ready removal of the foil is effected by the device of the invention; and a clear tamper-evident residue remains on the lip of the container, as clearly shown in FIG. 8. This is not true of the prior art device of FIGS. 1 and 1A. If the device of FIGS. 1 and 1A is fusion bonded to the lip of the container to provide tamper-evident characteristics, it is very difficult to remove the prior art device. That is not true of the device illustrated in FIGS. 2 and 4 through 8.

The foregoing description of the invention should be considered as illustrative, and not as limiting. Various changes and modifications will occur to those skilled in the art, without departing from the true scope of the invention as set forth in the following claims.

I claim:

1. A liner for use in closing a container opening in induction-sealed systems, said liner including in combination:

a fusion-bond heat seal polymer layer for fusion bonding to a container opening;

a relatively high-strength backing layer; and a relatively low-cohesive strength layer between, and bonded to, said polymer layer and said backing layer, said low-cohesive strength layer shearing, upon removal of said backing layer by mechanical forces, to separate said backing layer, with a first portion of the low-cohesive strength layer adhering thereto, from said polymer layer, with a second portion of the low-cohesive strength layer adhering to said polymer layer as a relatively low pressure rupturable tamper-evident cover over the container opening.

2. The combination according to claim 1 wherein said polymer layer is a polymer membrane.

3. The combination according to claim 2 wherein said low-cohesive strength layer is selected from the class of paper, glassine, and non-woven fabric.

4. The combination according to claim 3 further including a pull-tab extending outwardly from said liner to facilitate removal of said backing layer by shearing said low-cohesive strength layer when said pull tab is pulled to produce said mechanical forces.

5. The combination according to claim 4 wherein said backing layer comprises a first portion in the form of a metal foil having two surfaces, and a second portion in the form of a tear-resistant backing, with the tear-resistant backing bonded to one surface of the metal foil, and said low-cohesive strength layer bonded to the other surface of said metal foil.

6. The combination according to claim 5 wherein said metal foil is aluminum foil.

7. The combination according to claim 1 wherein said low-cohesive strength layer is selected from the class of paper, glassine, and non-woven fabric.

8. The combination according to claim 7 further including a pull-tab extending outwardly from said liner to facilitate removal of said backing layer by shearing said low-cohesive strength layer when said pull tab is pulled to produce said mechanical forces.

9. The combination according to claim 1 wherein said backing layer comprises a first portion in the form of a metal foil having two surfaces, and a second portion in the form of a tear-resistant backing, with the tear-resistant backing bonded to one surface of the metal foil, and said low-cohesive strength layer bonded to the other surface of said metal foil.

10. The combination according to claim 9 wherein said metal foil is aluminum foil.

11. The combination according to claim 1 further including a pull-tab extending outwardly from said liner to facilitate removal of said backing layer by shearing said low-cohesive strength layer when said pull tab is pulled to produce said mechanical forces.

* * * * *